US008646871B2

(12) United States Patent
Park

(10) Patent No.: US 8,646,871 B2
(45) Date of Patent: Feb. 11, 2014

(54) IMAGE FORMING APPARATUS

(75) Inventor: Soyoung Park, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 13/359,923

(22) Filed: Jan. 27, 2012

(65) Prior Publication Data

US 2012/0224000 A1 Sep. 6, 2012

(30) Foreign Application Priority Data

Mar. 1, 2011 (JP) ..... 2011-043695

(51) Int. Cl.
*B41J 2/165* (2006.01)

(52) U.S. Cl.
USPC ..... 347/30; 347/22; 347/29; 347/36

(58) Field of Classification Search
USPC ..... 347/22, 29, 30, 33, 35, 36
See application file for complete search history.

(56) References Cited

U.S. PATENT DOCUMENTS

2009/0015630 A1* 1/2009 Murayama ..... 347/33

FOREIGN PATENT DOCUMENTS

| | | |
|---|---|---|
| JP | 2000-108383 | 4/2000 |
| JP | 2001-187473 | 7/2001 |
| JP | 2001-341321 | 12/2001 |
| JP | 2007-210121 | 8/2007 |
| JP | 2009-51058 | 3/2009 |

OTHER PUBLICATIONS

U.S. Appl. No. 13/217,431, filed Aug. 25, 2011.
U.S. Appl. No. 13/222,164, filed Aug. 31, 2011.
U.S. Appl. No. 13/289,070, filed Nov. 4, 2011.
U.S. Appl. No. 13/297,677, filed Nov. 16, 2011.

* cited by examiner

*Primary Examiner* — Jannelle M Lebron
(74) *Attorney, Agent, or Firm* — Cooper & Dunham LLP

(57) ABSTRACT

An image forming apparatus including a recording head having an array of nozzles disposed in a surface of the recording head to eject liquid droplets vertically upward to form an image on a recording medium conveyed above the recording head, a suction cap to cover the surface of the recording head from above, and a waste liquid receiver provided to a periphery of the recording head to receive liquid streaming down the periphery of the recording head upon removal of the suction cap from the surface of the recording head.

8 Claims, 5 Drawing Sheets

IMAGE FORMING APPARATUS

CROSS-REFERENCE TO RELATED APPLICATION

The present patent application is based on and claims priority pursuant to 35 U.S.C. §119 from Japanese Patent Application No. 2011-043695, filed on Mar. 1, 2011 in the Japan Patent Office, which is incorporated by reference herein in its entirety.

BACKGROUND OF THE INVENTION

1. Field of the Invention

Exemplary aspects of the present invention generally relate to an image forming apparatus, and more particularly to an image forming apparatus including a recording head that ejects liquid droplets vertically upward.

2. Description of the Related Art

One example of related-art image forming apparatuses such as printers, copiers, plotters, facsimile machines, and multifunction devices having two or more of printing, copying, plotting, and facsimile capabilities is an inkjet recording device employing a liquid ejection recording method. The inkjet recording device includes a recording head that ejects droplets of a recording liquid such as ink from nozzles in the recording head onto a sheet of recording media while the sheet is conveyed to form an image on the sheet. Examples of an inkjet recording device include a serial-type image forming apparatus, in which the recording head ejects ink droplets while moving in a main scanning direction to form an image on the sheet as the sheet is moved in a sub-scanning direction perpendicular to the main scanning direction, and a line-type image forming apparatus equipped with a line-type recording head that ejects ink droplets and does so without moving to form an image on the sheet as the sheet is moved in the sub-scanning direction.

The recording head typically ejects ink droplets vertically downward onto a sheet conveyed past the recording head so that an image is formed on an upward facing side of the sheet. The inkjet recording device further includes a servicing mechanism to maintain stable ejection of ink droplets from the nozzles in the recording head (i.e., to keep the nozzles clean). The servicing mechanism includes a cap that covers a nozzle surface of the recording head (i.e., the face of the recording head in which the nozzles are disposed) to prevent ink within the nozzles from getting dried out and clogging the nozzles and dust and foreign substances from entering the nozzles, a wiper that wipes off the nozzle surface of the recording head to clean the nozzle surface, and so forth. After viscous ink is discharged from the nozzles into the cap that covers the nozzle surface, the wiper wipes off the nozzle surface to form a meniscus at the nozzles, thereby servicing the recording head.

There are known inkjet recording devices in which the recording head ejects ink droplets upward against the force of gravity from the nozzles to form an image on a downward facing side of a sheet. Such an inkjet recording device further includes an ink receiver that receives ink preliminary ejected from the nozzles to maintain stable ejection of ink droplets from the nozzles. The ink receiver has an opening through which the ink preliminary ejected from the nozzles enter the ink receiver. The ink receiver further has a leakage prevention unit provided above the opening so that the ink is prevented from leaking from the ink receiver via the opening.

However, when a nozzle surface of the recording head is capped with a cap member to discharge waste ink from the nozzles to the cap member, the cap member is filled with the waste ink thus discharged. Consequently, in the recording head that ejects the ink droplets vertically upward, the waste ink drops off from the recording head to inside the inkjet recording device when the cap member is removed from the nozzle surface of the recording head. Further, a larger amount of waste ink remains attached to the nozzle surface of the recording head after removal of the cap member from the nozzle surface, thereby increasing wiping and cleaning load.

BRIEF SUMMARY OF THE INVENTION

In view of the foregoing, illustrative embodiments of the present invention provide a novel image forming apparatus that ejects liquid droplets vertically upward to prevent waste liquid discharged from a recording head to a cap member from dropping off from the recording head to a carriage or inside the image forming apparatus.

In one illustrative embodiment, an image forming apparatus includes a recording head having an array of nozzles disposed in a surface of the recording head to eject liquid droplets vertically upward to form an image on a recording medium conveyed above the recording head, a suction cap to cover the surface of the recording head from above, and a waste liquid receiver provided to a periphery of the recording head to receive liquid streaming down the periphery of the recording head upon removal of the suction cap from the surface of the recording head.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
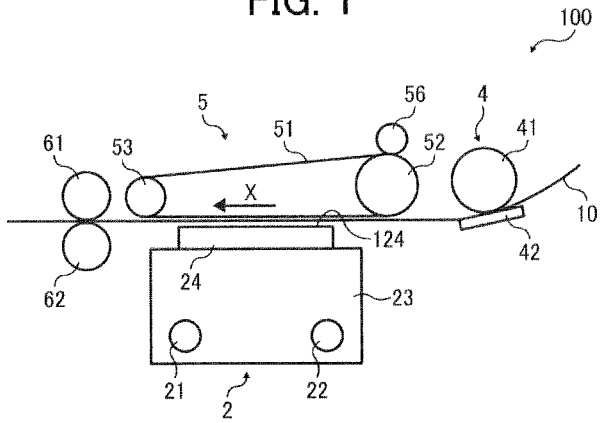
FIG. 1 is a vertical cross-sectional view illustrating an example of a configuration of main components of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Image forming apparatuses hereinafter described form an image on a recording medium, such as paper, string, fiber, cloth, lather, metal, plastics, glass, wood, and ceramics by ejecting ink droplets onto the recording medium. In this specification, an "image" refers to both signifying images, such as characters and figures, as well as a non-signifying image such as patterns, and moreover is not limited to a flat image, but also includes an image formed on a three-dimensional object, a three-dimensional image, and so forth. In addition, the term "ink" includes any material which is a liquid when ejected from the image forming apparatuses to form images on the recording medium. A "sheet" of recording media is not limited to a sheet of paper but also includes any material onto which ink droplets adhere, such as an OHP sheet and the examples of the recording medium described above.

A configuration and operation of an image forming apparatus 100 according to illustrative embodiments are described below, with reference to FIGS. 1 and 2. The image forming apparatus 100 is a serial-type inkjet recording device including recording heads 24*a* and 24*b* described in detail later.

Figure 2:
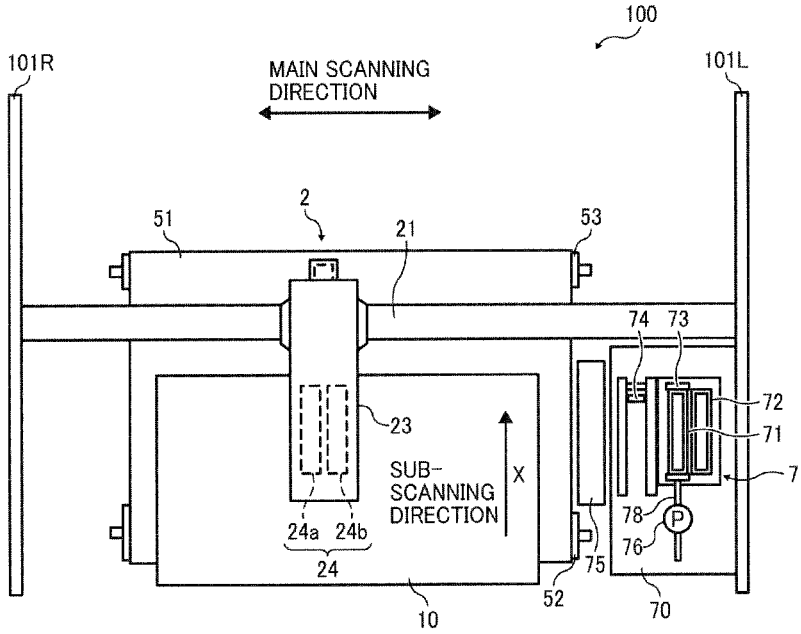
FIG. 2 is a schematic bottom view illustrating the main components of the image forming apparatus.

FIG. 1 is a vertical cross-sectional view illustrating an example of a configuration of main components of the image forming apparatus 100 according to illustrative embodiments. FIG. 2 is a schematic bottom view illustrating the main components of the image forming apparatus 100.

The image forming apparatus 100 includes an image forming unit 2, a sheet feeder 4, a conveyance mechanism 5, and so forth. A sheet 10 fed from the sheet feeder 4 is intermittently conveyed to the image forming unit 2 by the conveyance mechanism 5 so that the image forming unit 2 ejects ink droplets vertically upward onto a downward facing side of the sheet 10 to form an image. The sheet 10 having the image thereon is then discharged to a discharge tray, not shown.

More specifically, a sheet feed roller 41 and a separation pad 42, both provided to the sheet feeder 4, separate the sheets 10 one by one to feed each of the sheets 10 to the conveyance mechanism 5. The conveyance mechanism 5 includes a conveyance roller 52, a driven roller 53, and a seamless conveyance belt 51 wound around the conveyance roller 52 and the driven roller 53. The conveyance belt 51 is charged by a charging roller 56 so that the sheet 10 is electrostatically attracted to the conveyance belt 51 and is conveyed in a direction of rotation of the conveyance belt 51, that is, the sub-scanning direction X, to face the recording heads 24*a* and 24*b* as the conveyance belt 51 rotates. Discharge rollers 61 and 62 that discharge the sheet 10 having the image thereon to the discharge tray are provided downstream from the conveyance mechanism 5 in a direction of conveyance of the sheet 10.

In the image forming unit 2, a carriage 23 in which the recording heads 24*a* and 24*b* (hereinafter collectively referred to as recording heads 24 when not distinguished from each other) are installed is slidably supported by a main guide member 21 and a sub-guide member 22, both extended between right and left lateral plates 101R and 101L and parallel to each other. The carriage 23 is reciprocally movable in a main scanning direction by a main scanning motor, not shown, via a timing belt wound around a drive pulley and a driven pulley.

The recording heads 24, each constituted of a liquid ejection head that ejects ink droplets of a specific color, that is, yellow (Y), magenta (M), cyan (C), or black (K), and a head tank, not shown, that supplies ink to the recording heads 24, are installed on the carriage 23.

Nozzle arrays each constituted of multiple nozzles 120 are provided to a nozzle surface 124 of each of the recording heads 24*a* and 24*b* and arrayed in a sub-scanning direction indicated by arrow X perpendicular to the main scanning direction, such that the recording heads 24 eject ink droplets of the specified colors vertically upward. Specifically, each of the recording heads 24*a* and 24*b* has two nozzle arrays. Yellow ink droplets (Y) are ejected from a first nozzle array formed in the recording head 24*a*, and magenta ink droplets (M) are ejected from a second nozzle array formed therein. Similarly, black ink droplets (K) are ejected from a first nozzle array formed in the recording head 24*b*, and cyan ink droplets (C) are ejected from a second nozzle array formed therein.

A servicing mechanism 7 that services the nozzles 120 in the recording heads 24 is provided outside the imaging range of the image forming unit 2 in the main scanning direction. The servicing mechanism 7 is constructed of a suction cap 71 and a moisture retention cap 72, each of which covers the nozzle surface 124 of the recording head 24*a* or 24*b*, and a wiper blade 74 that wipes off the nozzle surface 124, all of which are supported by a frame 70. The suction cap 71 is held by a cap holder 73. The servicing mechanism 7 further includes an ink receiver 75 that receives ink droplets not used for image formation and preliminarily ejected from the recording heads 24 to remove coagulated ink from the recording heads 24. The suction cap 71 is connected to a suction unit, which, in the present illustrative embodiment, is a suction pump 76 connected to a waste tank, not shown.

A stepping motor, not shown, for the capping mechanism is provided inside the frame 70 of the servicing mechanism 7. Forward rotation of the stepping motor caps and decaps the nozzle surface 124 of the recording head 24*a* or 24*b* with the suction cap 71 or the moisture retention cap 72 in conjunction with the cap holder 73, via gears and cams, not shown. Reverse rotation of the stepping motor drives the suction pump 76.

As described previously, the sheet 10 fed from the sheet feeder 4 is electrostatically attracted to the conveyance belt 51 charged by the charging roller 56 to be conveyed in a horizontal direction as the conveyance belt 51 rotates. The recording heads 24 are driven based on image signals while the carriage 23 is moved so that ink droplets are ejected from the recording heads 24 onto the sheet 10, which remains stationary, so as to form a single line in an image to be formed on the sheet 10. Thereafter, the conveyance mechanism 51 conveys the sheet 10 by a predetermined amount to perform image formation of the next line. Upon completion of image formation, the sheet 10 having the image thereon is discharged to the discharge tray.

The carriage 23 is moved to a home position to face the servicing mechanism 7 during servicing of the nozzles 120 in the recording heads 24. The nozzle surface 124 of the recording head 24*a* or 24*b* is capped with the suction cap 71 so that coagulated ink is sucked out from the nozzles 120 into the suction cap 71 and ink droplets not used for image formation are idly ejected from the nozzles 120 to the suction cap 71 so as to service the nozzles 120, thereby providing stable ejection of ink droplets from the recording heads 24 and achieving higher-quality image formation.

Figure 3:
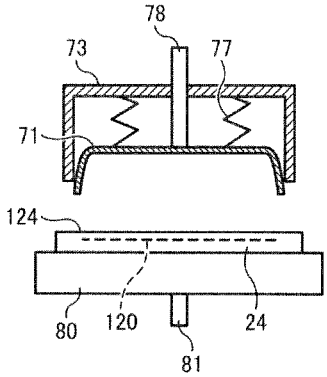
FIG. 3 is a vertical cross-sectional view illustrating an example of a configuration of a capping mechanism and a recording head both provided to an image forming apparatus according to a first illustrative embodiment.
Figure 4:
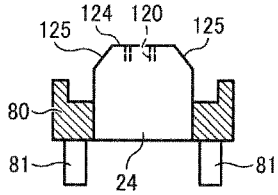
FIG. 4 is an enlarged vertical cross-sectional view illustrating the recording head illustrated in FIG. 3.

A description is now given of a first illustrative embodiment of the present invention, with reference to FIGS. 3 to 5. FIG. 3 is a vertical cross-sectional view illustrating an example of a configuration of the capping mechanism and the recording head 24 both provided to the image forming apparatus 100 according to the first illustrative embodiment. FIG. 4 is an enlarged vertical cross-sectional view illustrating the recording head 24 illustrated in FIG. 3. FIGS. 5A to 5E are vertical cross-sectional views illustrating transitional states of the capping mechanism and the recording head 24 during cleaning.

The suction cap 71 covers the nozzle surface 124 of the recording head 24*a* or 24*b* from the top of the recording head 24. Therefore, the suction cap 71 is held by the cap holder 73 such that an opening of the suction cap 71 faces downward. A spring 77 is provided between the cap holder 73 and the suction cap 71. The suction cap 71 is connected to the suction pump 76 via a suction tube 78.

A waste ink receiver 80 that receives waste ink streaming down a periphery of the recording head 24 upon removal of the suction cap 71 from the nozzle surface 124 is provided to the periphery of the recording head 24. The periphery of the recording head 24 further has sloped surfaces 125 tilting downward from edges of the nozzle surface 124 positioned perpendicular to the nozzle arrays. The waste ink receiver 80 is connected to the waste tank, not shown, via a discharge tube 81. It is to be noted that both the waste ink receiver 80 and the waste tank are held in the carriage 23.

The servicing mechanism 7 performs cleaning of the recording head 24 when the nozzles 120 are clogged with coagulated ink or dust. Cleaning of the recording head 24 includes the steps of sucking out coagulated ink from the nozzles 120, wiping off the nozzle surface 124, and idly ejecting ink droplets not used for image formation but instead simply clear the nozzles 120. The suction process is performed in the following order: Capping the nozzle surface 124 with the suction cap 71, sucking out coagulated ink from the nozzles 120 to the suction cap 71, removing the suction cap 71 from the nozzle surface 124, and discharging the ink from the suction cap 71.

Figure 5A:
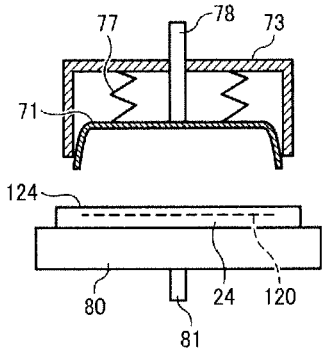
FIGS. 5A to 5E are vertical cross-sectional views illustrating transitional states of the capping mechanism and the recording head during cleaning according to the first illustrative embodiment.
Figure 5B:
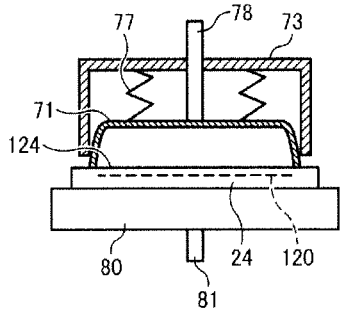
Figure 5C:
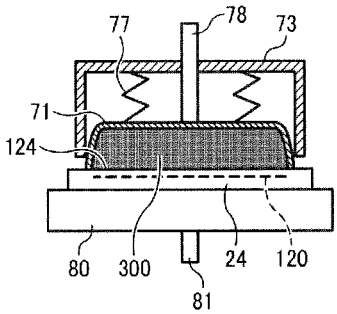
Figure 5D:
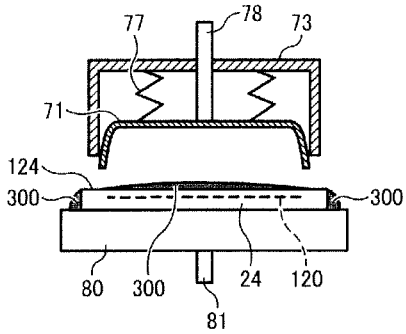

Specifically, first, the cap holder 73 is lowered from the state illustrated in FIG. 5A so that the nozzle surface 124 of the recording head 24 is capped with the suction cap 71 as illustrated in FIG. 5B. Then, the suction pump 76 is driven to suck out coagulated ink from the nozzles 120 of the recording head 24 into the suction cap 71. Thus, the suction cap 71 is filled with waste ink 300 as illustrated in FIG. 5C. Thereafter, when the suction cap 71 is removed from the nozzle surface 124, the waste ink 300 in the suction cap 71 streams down the periphery of the recording head 24 as illustrated in FIG. 5D.

As described above, the waste ink receiver 80 is provided to the periphery of the recording head 24. Therefore, the waste ink 300 streaming down the periphery of the recording head 24 is received by the waste ink receiver 80 and is prevented from dropping onto a bottom portion of the image forming apparatus 100 below the recording head 24. The waste ink 300 received by the waste ink receiver 80 is discharged to the waste tank via the discharge tube 81.

Figure 5E:
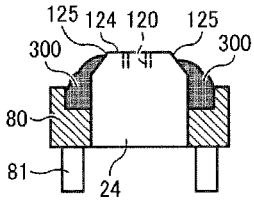

The sloped surface 125 provided to the periphery of the recording head 24 cause the waste ink 300 remaining on the nozzle surface 124 to easily flow into the waste ink receiver 80 as illustrated in FIG. 5E.

Next, the carriage 23 is moved to a wiping position so that the wiper blade 74 wipes off the nozzle surface 124 of the recording head 24. Thereafter, the carriage 23 is moved to the ink receiver 75 so that ink droplets not used for image formation are idly ejected from the nozzles 120 into the ink receiver 75.

Thus, provision of the waste ink receiver 80 to the periphery of the recording head 24 can reliably guide the waste ink 300 to the waste tank after removal of the suction cap 71 from the nozzle surface 124 even when a large amount of ink is sucked out from the nozzles 120 into the suction cap 71 depending on usage. Accordingly, the waste ink 300 is prevented from dropping onto electrical components such as a driver IC that drives the recording heads 24, thereby preventing irregular ejection of ink droplets from the recording heads 24 caused by adhesion of the waste ink 300 to the electrical components. In addition, the waste ink 300 does not adhere around the recording head 24 in the above-described configuration, thereby preventing transfer of the waste ink 300 onto the sheet 10 or the conveyance belt 51 and deterioration of image quality. Further, the waste ink 300 accidentally dropping from the suction cap 71 due to troubles such as a sudden power blackout during suction of the ink can be reliably received by the waste ink receiver 80. As a result, dropping of the waste ink 300 onto the electrical components and transfer of the waste ink 300 onto the sheet 10 or the conveyance belt 51 are securely prevented.

Figure 6:
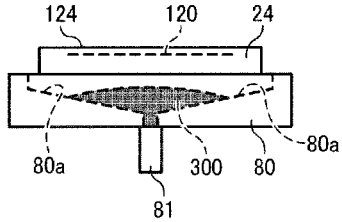
FIG. 6 is a vertical cross-sectional view illustrating an example of a configuration of a recording head provided to an image forming apparatus according to a second illustrative embodiment.

A description is now given of a second illustrative embodiment of the present invention, with reference to FIG. 6. FIG. 6 is a vertical cross-sectional view illustrating an example of a configuration of the recording head 24 provided to the image forming apparatus 100 according to the second illustrative embodiment.

In the second illustrative embodiment, the waste ink receiver 80 has sloped bottom surfaces 80*a* tilting downward from both ends to the center in a longitudinal direction, that is, parallel to the nozzle arrays.

As a result, the waste ink 300 received by the waste ink receiver 80 is corrected to the center of the waste ink receiver 80 and can be easily guided to the waste tank through the discharge tube 81. It is to be noted that the sloped bottom surfaces 80*a* with water repellency can more easily guide the waste ink 300 into the waste tank.

A description is now given of a third illustrative embodiment of the present invention, with reference to FIGS. 7A to 7E. FIGS. 7A to 7E are vertical cross-sectional views illustrating transitional states of the capping mechanism and the recording head 24 during cleaning, both provided to the image forming apparatus 100 according to the third illustrative embodiment.

In the third illustrative embodiment, an escape valve 79 that opens a space enclosed within the suction cap 71 to the atmosphere while the nozzle surface 124 is capped with the suction cap 71 is provided to a top portion of the suction cap 71. In addition, a suction tube 78 connected to the suction pump 76 is connected to the suction cap 71 on a side in which the suction cap 71 contacts the nozzle surface 124 in a lateral direction, that is, a direction perpendicular to the direction of nozzle arrays.

Because adhesion of the waste ink 300 to the escape valve 79 may increase operational load of the escape valve 79 and reduce the degree of sealing within the suction cap 71, it is preferable that the escape valve 79 be provided to a position such that adhesion of the waste ink 300 to the escape valve 79 is prevented. Alternatively, the escape valve 79 may be provided to a pressure release tube. In addition, a spring or the like may be used to provide the escape valve 79 to the cap holder 73 so that opening and closing of the escape valve 79 can be performed coextensively with capping and decapping of the suction cap 71.

Figure 7A:
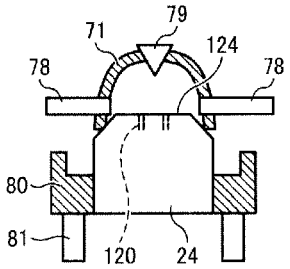
FIGS. 7A to 7E are vertical cross-sectional views illustrating transitional states of a capping mechanism and a recording head during cleaning, both provided to an image forming apparatus according to a third illustrative embodiment.
Figure 7B:
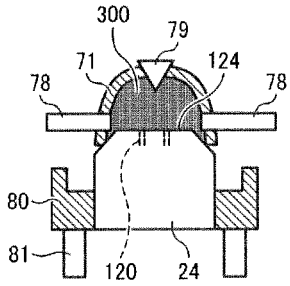

In the third illustrative embodiment, first, the nozzle surface 124 of the recording head 24 is capped with the suction cap 71 as illustrated in FIG. 7A, and then the suction pump 76 is driven while the escape valve 79 is closed to suck out coagulated ink from the nozzles 120 of the recording head 24 into the suction cap 71. Thus, the suction cap 71 is filled with the waste ink 300 as illustrated in FIG. 7B.

Figure 7C:
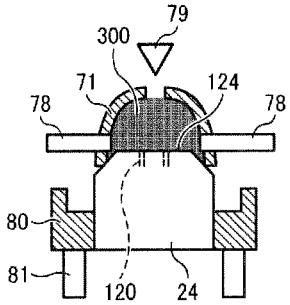
Figure 7D:
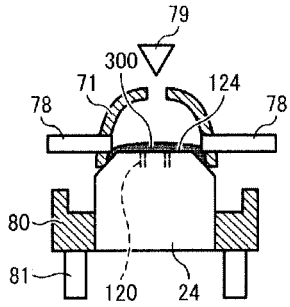

Next, the escape valve 79 is opened as illustrated in FIG. 7C so that the space enclosed within the suction cap 71 is opened to atmosphere, and then the suction pump 76 is driven to suck out and discharge the waste ink 300 from the suction cap 71 to the discharge tube 81. Accordingly, an amount of the waste ink 300 within the suction cap 71 is reduced as illustrated in FIG. 7D.

Figure 7E:
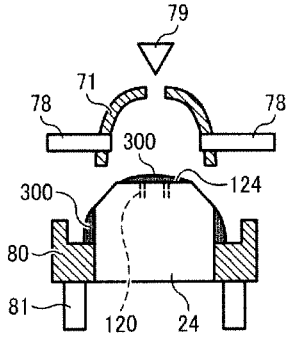

Thereafter, the suction cap 71 is removed from the nozzle surface 124 as illustrated in FIG. 7E.

At this time, the waste ink 300 remaining on the nozzle surface 124 streams down the periphery of the recording head 24 and is received by the waste ink receiver 80.

Thus, the space enclosed within the suction cap 71 is opened to atmosphere after the ink is sucked out from the nozzles 120 into the suction cap 71. Accordingly, the waste ink 300 is discharged from the suction cap 71 so that the amount of waste ink 300 within the suction cap 71 is reduced before the suction cap 71 is removed from the nozzle surface 124. As a result, an amount of the waste ink 300 streaming down the periphery of the nozzle surface 124 upon removal of the suction cap 71 is also reduced. Therefore, an amount of the waste ink 300 flowing into the waste ink receiver 80 is also reduced, thereby improving durability of the waste ink receiver 80.

Figure 8:
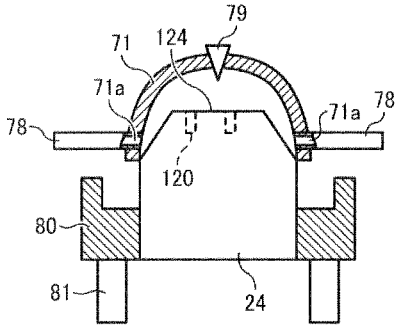
FIG. 8 is a vertical cross-sectional view illustrating an example of a configuration of a capping mechanism and a recording head during cleaning, both provided to an image forming apparatus according to a fourth illustrative embodiment.

A description is now given of a fourth illustrative embodiment of the present invention, with reference to FIG. 8. FIG. 8 is a vertical cross-sectional view illustrating an example of a configuration of the capping mechanism and the recording head 24 during cleaning, both provided to the image forming apparatus 100 according to the fourth illustrative embodiment.

In the fourth illustrative embodiment, the suction cap 71 further has a suction opening 71*a* connected to the suction pump 76 via the suction tube 78. The suction opening 71*a* is positioned below the nozzle surface 124 of the recording head 24 when the nozzle surface 124 is capped with the suction cap 71.

As a result, an amount of the waste ink 300 remaining on the nozzle surface 124 before removal of the suction cap 71 can be further reduced compared to the third illustrative embodiment.

Figure 9:
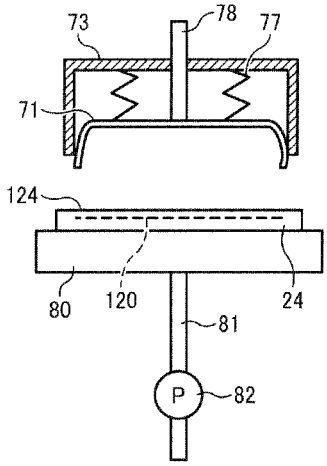
FIG. 9 is a vertical cross-sectional view illustrating an example of a configuration of a capping mechanism and a recording head during cleaning, both provided to an image forming apparatus according to a fifth illustrative embodiment.

A description is now given of a fifth illustrative embodiment of the present invention, with reference to FIG. 9. FIG. 9 is a vertical cross-sectional view illustrating an example of a configuration of the capping mechanism and the recording head 24 during cleaning, both provided to the image forming apparatus 100 according to the fifth illustrative embodiment.

In the fifth illustrative embodiment, a suction/discharge unit, which is a suction pump 82, is provided to the discharge tube 81 connected to the waste ink receiver 80. It is to be noted that, although the suction pump 82 shown in FIG. 9 is provided to the configuration according to the first illustrative embodiment, alternatively, it may be provided to the configuration of the second, third, or fourth illustrative embodiment.

The suction pump 82 is driven after wiping of the nozzle surface 124 with the wiper blade 74 to discharge the waste ink 300 from the waste ink receiver 80 together with waste ink wiped off from the nozzle surface 124 by the wiper blade 74 and corrected to the waste ink receiver 80.

It is to be noted that the foregoing illustrative embodiments are applicable not only to the serial-type image forming apparatuses but also to line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a recording head having an array of nozzles disposed in an upper surface of the recording head to eject liquid droplets vertically upward to form an image on a recording medium conveyed above the recording head;

a conveyance belt provided above the recording head and facing the array of nozzles of the recording head, the conveyance belt attracting the recording medium to transport the recording medium above the array of nozzles of the recording head; and a suction cap arranged above the recording head to cover the upper surface of the recording head from above, wherein the recording head includes a waste liquid receiver provided to a periphery of the recording head to receive liquid streaming down the periphery of the recording head upon removal of the suction cap from the upper surface of the recording head.

2. The image forming apparatus according to claim 1, wherein the suction cap comprises a suction opening connected to a suction unit, the suction opening being at least partially disposed below the upper surface of the recording head.

3. The image forming apparatus according to claim 1, wherein the periphery of the recording head comprises a sloped surface sloping downward and outward from edges of the upper surface of the recording head.

4. The image forming apparatus according to claim 1, wherein the waste liquid receiver has a sloped bottom.

5. The image forming apparatus according to claim 1, further comprising a suction/discharge unit to which the waste liquid receiver is connected to suck out and discharge the liquid from the waste liquid receiver.

6. The image forming apparatus according to claim 1, wherein the suction cap comprises an escape valve to open a space enclosed within the suction cap to atmosphere.

7. The image forming apparatus according to claim 1, wherein the recording head, disposed below the conveyance belt attracting the recording medium, eject liquid droplets vertically upward to form the image on the recording medium while the recording medium is conveyed by conveyed the conveyance belt disposed above the recording head.

8. The image forming apparatus according to claim 1, wherein the recording head includes peripheral walls descending from the upper surface of the recording head, and the waste liquid receiver of the recording head is disposed adjacent to said peripheral walls, and wherein in a maintenance operation, the waste liquid receiver of the recording head collects the liquid streaming down said peripheral walls of the recording head upon removal of the suction cap from the upper surface of the recording head.

* * * * *